United States Patent [19]

Frischmann et al.

[11] 4,282,046

[45] * Aug. 4, 1981

[54] METHOD OF MAKING PERMANENT MAGNETS AND PRODUCT

[75] Inventors: Peter G. Frischmann, Scotia; Fred E. Luborsky, Schenectady; Russell E. Tompkins, Scotia, all of N.Y.

[73] Assignee: General Electric Company, Schenectady, N.Y.

[ * ] Notice: The portion of the term of this patent subsequent to Nov. 18, 1997, has been disclaimed.

[21] Appl. No.: 58,062

[22] Filed: Jul. 16, 1979

Related U.S. Application Data

[63] Continuation of Ser. No. 898,820, Apr. 21, 1978, abandoned.

[51] Int. Cl.[3] ..... H01F 1/00

[52] U.S. Cl. ..... 148/121; 148/31.57; 148/101

[58] Field of Search ..... 148/31.55, 31.57, 101, 148/121; 75/122, 134 F, 170

[56] References Cited

U.S. PATENT DOCUMENTS

| | | | |
|---|---|---|---|
| 3,892,605 | 7/1975 | Thornburg | 148/121 |
| 4,036,638 | 7/1977 | Ray et al. | 75/170 |
| 4,053,331 | 10/1977 | Graham et al. | 148/120 |
| 4,053,333 | 10/1977 | Egami et al. | 75/170 |
| 4,056,411 | 11/1977 | Chen et al. | 148/121 |
| 4,065,330 | 12/1977 | Masumoto et al. | 148/121 |
| 4,067,321 | 1/1978 | Ray | 75/128 B |
| 4,081,298 | 3/1978 | Mendelsohn et al. | 75/122 |
| 4,113,478 | 9/1978 | Tanner | 75/177 |
| 4,116,728 | 9/1978 | Becker et al. | 148/31.55 |
| 4,152,144 | 5/1979 | Hasegawa et al. | 75/122 |
| 4,188,211 | 2/1980 | Yamaguchi et al. | 75/170 |

FOREIGN PATENT DOCUMENTS

| | | | |
|---|---|---|---|
| 51-73923 | 6/1976 | Japan | 148/121 |
| 508533 | 11/1974 | U.S.S.R. | 148/121 |
| 446555 | 12/1974 | U.S.S.R. | 148/121 |

OTHER PUBLICATIONS

Hasegawa et al., "Advances in Ferromagnetic Metallic Glasses," Magnetism and Magnetic Materials-1976, Amer. Inst. Phys., pp. 298-303.

Coleman, "Crystallization of Fe, Co and Ni Based Metallic Glasses," Mat. Sci. & Eng., 23 (1976), pp. 161-167.

Egami, et al., "Amorphous Alloys as Soft Magnetic Materials," Magnetism and Magnetic Materials-1974, Amer. Inst. Phys., pp. 697-701.

*Primary Examiner*—Aaron Weisstuch
*Assistant Examiner*—John P. Sheehan
*Attorney, Agent, or Firm*—Leo I. MaLossi; James C. Davis, Jr.

[57] ABSTRACT

A hard magnetic article made by casting a magnetically soft amorphous metal ribbon and shaping it to the form and size of the desired permanent magnet article, and then heat treating the resulting soft magnetic body and thereby converting the metal of the ribbon to the hard magnetic state.

9 Claims, No Drawings

METHOD OF MAKING PERMANENT MAGNETS AND PRODUCT

The Government has rights in this invention pursuant to Contract No. N00014-76-C-0807 awarded by the Office of Naval Research, Department of the Navy.

CROSS REFERENCE

This is a continuation of application Ser. No. 898,820, filed Apr. 21, 1978, now abandoned.

The present invention relates generally to the magnetic alloy art and is more particularly concerned with a novel method of making permanent magnets and with the resulting hard magnetic articles.

This invention is related to the invention disclosed and claimed in our copending patent application Ser. No. 898,919 (filed of even date with the parent of this application) entitled "Amorphous Metal Electric Motor Components and Motors Incorporating Same and Method"—Frischmann et al. and assigned to the assignee of this application. Ser. No. 898,919 is directed to the concept of casting a magnetic alloy in ductile amorphous ribbon form and winding it or otherwise shaping it to an hysteresis motor rotor and then with the ribbon secured to the rotor annealing the assembly to crystallize the metal of the ribbon and increase its coercive force to a level making the rotor useful in the usual association with the stator of an hysteresis motor.

BACKGROUND OF THE INVENTION

It has long been generally recognized that the cost of permanent magnets and magnetic materials is comparatively high. It has likewise been apparent that material costs and manufacturing process complexities are the major expense factors in these products. Thus, prior efforts of others to bring down these costs have not been successful even though from time to time the art has advanced substantially as new permanent magnet materials and new processes for producing them have been invented or discovered.

SUMMARY OF THE INVENTION

The process which we have invented for producing permanent magnet materials is substantially less complicated and expensive to carry out than any known heretofore. It is basically and generally a two-step process which involves casting a magnetic alloy and heat treating the resulting solid amorphous soft magnetic article to crystallize the metal of the article and convert it to the hard magnetic state. No hot or cold working step is required, nor is it necessary to carry out a magnetic anneal or, in fact, more than a single simple anneal. Neither is it necessary to perform an alignment operation on powder particles or grains in order to obtain consistently a product which has good permanent magnet properties. An additional advantage of this invention, when practiced as a three-step process, is that while the end product permanent magnet is relatively hard and brittle, the precursor soft magnetic amorphous intermediate product is ductile enough that it can be shaped to provide finished articles of a wide variety of forms and sizes.

In the preferred practice of this invention, a metalloid-containing magnetic alloy such as $Fe_{40}Ni_{40}P_{14}B_6$ which can be produced in glassy or amorphous form is melted and cast as a thin ribbon as the initial step of this new method. This casting operation is preferably carried out as disclosed in copending patent application Ser. No. 885,436, filed Mar. 10, 1978, in the name of John Lee Walter and assigned to the assignee hereof. The resulting ribbon of uniform thickness and width and of the desired length has smooth, pit-free surfaces and good ductility but very low coercive force. In this form, the ribbon can be tightly coiled and similarly shaped without tearing or breaking and is magnetically soft.

As the second step of the process, the amorphous metal ribbon still in its ductile, glassy and soft magnetic condition is wound in a plurality of overlapping layers of the ribbon to build up a solid body or is otherwise formed in the size and shape of the desired permanent magnet article. Thus, as described in copending patent application Ser. No. 898,919 referenced above, the ductile ribbon can readily be applied in the form of the magnetic component on or to the rotor shaft of a synchronous electric motor.

As the final step of this preferred form of the method of this invention, the solid body of soft magnetic amorphous metal built-up from wound or coiled ribbon is heat treated or annealed at a temperature and for a time sufficient to cause crystallization of the amorphous metal and grain growth to the extent necessary to provide the coercive force desired. Time and temperature requirements of the heat treatment will depend to some extent upon the particular amorphous magnetic alloy and also within limits one may choose between lower and higher temperatures and longer and shorter heat treatments for the same coercive force end result. In the case of the $Fe_{40}Ni_{40}P_{14}B_6$ alloy, we have found 580° C. and two hours to be optimum for this heat treatment step which is carried out, in any event, in an atmosphere which is non-reactive or neutral with respect to the metal parts being subjected to the elevated temperature condition.

As those skilled in the art will understand, this new method of ours can be carried out to advantage as a two-step process, the special shaping operation being optional when the initial casting of the soft magnetic amorphous metal can be produced in the form and size of the desired permanent magnet article. Thus, the ductility property of the as-cast amorphous ribbon or other body will in some instances of the practice of this invention be of only incidental interest. The amorphous or glassy nature of the soft magnetic amorphous metal of the cast body will, however, always be of prime importance because it is this property which for the first time enables the development of a continuum of hard magnetic properties. This is because the grain size can readily be closely controlled during the crystallization step of this new method as the grains are nucleated and grown to the desired size out of the amorphous metal yielding the desired coercive force.

As indicated above, this invention of ours is applicable to magnetic metals and alloys which can be produced in the solid amorphous or glassy condition and which can be converted by annealing at some temperature for some period of time to permanent magnetic state. It is not essential that the as-cast body be completely amorphous, but for best results in terms of the magnetic properties of the finished permanent magnet product there should be no more than 25 percent of the volume in crystalline form.

In general, alloys useful in this new method include those of the iron-nickel-cobalt series containing a glassforming element or mixture of them as represented by the following general formula:

$$(Fe_xNi_yCo_z)_{100-W}G_W$$

where G is silicon, phosphorus, boron, carbon, germanium, aluminum or other metalloid element or mixture thereof, and where W is from 10 to 30 atomic percent. Specific examples of such alloys having special utility in this invention include, in addition to the one treated in detail above, $Fe_{40}Ni_{40}B_{20}$, $Fe_{80}B_{20}$ and $Fe_{82}B_{18}$.

The product of the method of this invention is unique in that it is a hard magnet made from a soft magnet of precisely the same alloy composition and precisely the same physical size and shape. Further, it is a magnetically hard magnet made from a magnetically soft magnet by heat treatment alone. As set forth above, this new product of our invention is further characterized by its remarkably uniform and comparatively small grain size which is a consequence of the fact that the grains are nucleated and grown in the amorphous soft magnetic body as the heat treatment operation is carried out. The resulting grain structure of the finished permanent magnet product is such that magnetic domain wall migration is effectively inhibited or blocked which enables maximizing the magnetic properties through control of the heat treating operation.

What we claim and desire to secure by Letters Patent of the United States is:

1. The method of making a magnetically hard article having a desired shape, volume and coercive force, which comprises the steps of casting a magnetic alloy composition in the form of a ductile, magnetically-soft amorphous metal ribbon, tightly winding the ductile ribbon to build up substantially the desired article shape and volume, preselecting a value of coercive force to be provided to said article, heating said wound ribbon to a preselected temperature above the crystallizatiion temperature for said magnetic alloy, and maintaining said wound ribbon at said preselected temperature for a period of time at least sufficient to develop said preselected coercive force, whereby the desired magnetically hard article results.

2. The method of claim 1 in which the heating step is carried out so as to increase the grain size to maximize the coercive force of the resulting magnetically hard article.

3. The method of claim 1 in which the composition of the amorphous metal in $(Fe_xNi_yCo_z)_{100-W}G_W$, where G is silicon, phosphorus, boron, carbon, germanium, aluminum or mixture thereof, and where W is from 10 to 30 atomic percent.

4. The method of claim 3 wherein the composition is $Fe_{40}Ni_{40}B_{20}$.

5. The method of claim 3 wherein the composition is $Fe_{80}B_{20}$.

6. The method of claim 3 wherein the composition is $Fe_{82}B_{18}$.

7. The method of making a magnetically-hard article having a predetermined shape, volume and coercive force, which comprises the steps of casting a magnetic alloy composition in the form of ductile, magnetically-soft amorphous metal ribbon, forming a three-dimensional article with such ribbon arranged in overlapping relationship, preselecting a value of coercive force to be provided to said article, heating said overlapping ribbon to a preselected temperature above the crystallization temperature for said magnetic alloy, and maintaining said overlapping ribbon at said preselected temperature for a period of time at least sufficient to develop said preselected coercive force, whereby the desired magnetically-hard article results.

8. The method of claim 7 in which the heating step is carried out so as to increase the grain size to maximize the coercive force of the resulting magnetically hard article.

9. The magnetically hard article of wound or coiled ribbon made by the process of claim 7.

* * * * *